US006233755B1

(12) United States Patent
Shimizu

(10) Patent No.: US 6,233,755 B1
(45) Date of Patent: May 22, 2001

(54) HAIR WASHER

(75) Inventor: Hirohisa Shimizu, Osaka (JP)

(73) Assignee: Oohiro Works, Ltd., Osaka (JP)

( * ) Notice: Subject to any disclaimer, the term of this patent is extended or adjusted under 35 U.S.C. 154(b) by 0 days.

(21) Appl. No.: 09/475,888

(22) Filed: Dec. 30, 1999

(30) Foreign Application Priority Data

Apr. 1, 1999 (JP) ..... 11-095149

(51) Int. Cl.[7] ..... A45D 44/10

(52) U.S. Cl. ..... 4/523; 4/515; 4/516; 4/518; 4/519

(58) Field of Search ..... 4/515, 516, 517, 4/518, 519, 523, 545, 573.1, 575.1, 589, 621, DIG. 6; 607/81, 85, 86, 87, 104, 108, 109, 110, 111; 5/421; 297/180.15

(56) References Cited

U.S. PATENT DOCUMENTS 802,106 * 10/1905 Matteson ..... 4/DIG. 6
1,004,192 * 9/1911 Phelan ..... 5/421
1,078,207 * 11/1913 Michael ..... 5/421
1,839,156 * 12/1931 Lumpkin ..... 4/DIG. 6
2,913,833 * 11/1959 Glintz ..... 5/421
3,008,153 * 11/1961 Coulter .
3,103,219 * 9/1963 Chadner ..... 5/421
4,411,032 * 10/1983 Lewy ..... 4/515
4,901,378 * 2/1990 Reddell ..... 4/523

FOREIGN PATENT DOCUMENTS

625529 * 6/1949 (GB) ..... 4/523
1470165 * 4/1977 (GB) .

* cited by examiner

*Primary Examiner*—Henry J. Recla
*Assistant Examiner*—Khoa D. Huynh
(74) *Attorney, Agent, or Firm*—Burr & Brown

(57) ABSTRACT

A hair washer including a hot water storing tank for storing hot water, a cistern for receiving at least the hair of a person undergoing hair washing, a cistern including shower heads and nozzle heads in an interior thereof, a neck-receiving member provided on the cistern for supporting the back of the neck of a person undergoing hair washing, a conduit running below the neck-receiving member and connecting the hot water storing tank to the shower heads and nozzle heads in the cistern whereby the hot water passing through the conduit heats the neck-receiving member and thus the back of the neck of the person undergoing hair washing.

3 Claims, 7 Drawing Sheets

HAIR WASHER

FIELD OF THE INVENTION

The present invention relates to a hair washer which is established in a beauty salon, a barbershop or the like, and particularly to neck receiving part for supporting the nape of a person undergoing washing.

BACKGROUND OF THE INVENTION

FIG. 6 schematically illustrates the a structure of a prior art hair washer.

In the figure, reference numeral 1 designates a cabinet. Numeral 2 designates a cistern having an opening 2*a* in the cabinet 1, into which a person inserts his head while lying on his back, to undergo hair washing. A neck receiving member 103 is arranged at an entering edge part 2*b* of the cistern 2. The neck receiving part supports the nape of the person under hair washing 9 by a neck receiving part 103*a* of the neck receiving member. Here, the neck receiving member 103 is made of an elastic material, for example, a rubber or the like.

In addition, numeral 4 designates a face cover for preventing hot water from spreading over the face of the person under hair washing 9 during hair washing. The face cover is arranged to be capable of opening and closing so that it covers the opening 2*a* of the cistern 2. Numeral 5 designates a drawable hand shower used for washing off hairs, shampoo agent, or conditioner agent which are attached to a cistern, or in finishing hair washing. Numeral 6 designates a shampoo tank for storing shampoo agent. Numeral 7 designates a conditioner tank for storing conditioner agent.

FIG. 7 is a longitudinal sectional view schematically illustrating a structure of the prior art hair washer. In the figure, the same reference numerals and characters as those in FIG. 6 designate the same or corresponding parts. Reference numeral 8 designates a draining port provided at the bottom of the cistern 2. Numeral 9 designates a person undergoing hair washing.

Shower heads S1 to S11 for spouting hot water, and nozzle heads N1 to N6 for spouting hot water mixed with shampoo agent or conditioner agent are provided on inner walls of the cistern 2. Hair washing processes performed by a hair washer are completed by the following processes; an initial draining process, a preliminary washing process, a shampooing process, a first rinsing process, a conditioning process, anda second rinsing process. The shower heads S1 to S11 and the nozzle heads N1 to N6 are constructed to automatically spout hot water or hot water mixed with shampoo agent or conditioner agent during a prescribed period for the respective processes in accordance with control by a control means (not shown).

FIG. 8 is a diagram illustrating the pipe arrangement in the cabinet of the prior art hair washer. In the figure, the same reference numerals and characters as those in FIGS. 6 and 7 designate the same or corresponding parts. In addition, reference numeral 11 designates a mixing tank for mixing water and hot water which is transmitted from an external water supply and an external hot water supply, via a curb stop, a strainer, and a check valve (not shown), to prepare wash water having a temperature suitable for hair washing. Numeral 12 designates a motor valve. Numeral 13 designates a hot water storing tank for storing the wash water supplied from the mixing tank 11 via the motor valve 12. Numeral 14 designates a thermistor provided at a lower position of the hot water storing tank 13 to measure the temperature of the wash water stored in the hot water storing tank 13. Numeral 15 designates a float switch for detecting the amount of wash water stored in the hot water storing tank 13. Numeral 16 designates a hot water supplying pump for pumping out wash water from the hot water storing tank 13. Numeral 17 designates a valve for a hand shower. Character A designates a hot water supply way, one end of which is connected to the hot water supplying pump 16, the other end of which has some branches connected to the shower heads S1 to S11 and the nozzle heads N1 to N6 at top parts thereof. Numeral 18 designates a draining electromagnetic valve provided midway of the hot water supply way A to drain unnecessary wash water. Characters 19*a* to 19*k* designate hot water supplying electromagnetic valves for supplying the wash water to the shower heads S1 to S11 and nozzle heads N1 to N6 by an opening and closing of the supply of wash water via a closing operation. Numeral 20 designates a shampoo supplying pump for pumping out the shampoo agent from the shampoo tank 6. Numeral 21 designates a conditioner supplying pump for pumping out the conditioner agent from the conditioner tank 7. Numerals 22 and 23 designate check valves. Character B1 designates a shampoo agent supply way, one end of which is connected to the hot water supply way A, via the shampoo supplying pump 20 and the check valve 22. Character B2 designates a shampoo agent supply way, one end of which is connected to the conditioner tank 7, the other end of which is connected to the hot water supply way A, via the conditioner supplying pump 21 and the check valve 23.

Hereinafter, an explanation will be given of the operation of a hair washer constructed as described above with reference to FIGS. 6 to 8.

At first, when the hair washer is started, hot water and water are supplied to the mixing tank 11 from an external water supply and an external hot water supply, via the curb stop, the strainer, and the check valve. The hot water and the water are mixed by the mixing tank 11 to prepare the hot water having a temperature suitable for hair washing, which is provided to the hot water storing tank 13 via the motor valve 12.

At the time when predetermined amounts of hot water are stored in the hot water storing tank 13, stand-by mode follows. During the mode, after the person under hair washing inserts his head to the opening 2*a* of the cistern 2 while lying on his back and putting his head on the neck receiving part 3*a*, the face cover 4 is closed.

Next, when the hot water supplying electromagnetic valves 19*a* to 19*k* are opened, the hot water stored in the hot water storing tank 13 is simultaneously sucked up by the hot water supplying pump 16, to be provided to the hot water supply way A, whereby cold water stored in the hot water supply way A during an initial predetermined period is drained out from the shower heads S1 to S11 and the nozzle heads N1 to N6.

Next, when all the cold water stored in the hot water supply way A is drained out, the hot water supplying electromagnetic valve 19*k* is closed, in order to stop supplying hot water to the nozzle heads N1 to N6, thereby allowing hair washing to be performed utilizing the hot water spouted from the shower heads S1 to S11 during a predetermined period.

Next, a shampooing process is followed. When the hot water supplying electromagnetic valve 19*k* is opened, shampoo agent stored in the shampoo tank 6 is simultaneously sucked up by the shampoo supplying pump 20 via the shampoo agent supply way B1, and provided to the hot water supply way A via the check valve 22. The shampoo agent is mixed with the hot water of the hot water supply way A, thereby preparing mixed water with shampoo agent. The mixed water with the shampoo agent is spouted from the nozzle heads N1 to N6, to perform hair washing with shampoo agent with hot water spouted from the shower heads S1 to S11.

Next, when the shampooing process completed completed, the hot water supplying electromagnetic valve 19*k* is closed, to stop the spouting of the water mixed with shampoo agent from the nozzle heads N1 to N6, thereby performing a first rinsing of hair for washing away shampoo agent attached to the hair.

Next, a conditioning process is followed. When the hot water supplying electromagnetic valve 19*k* is opened, conditioner agent stored in the conditioner tank 7 is simultaneously sucked up by the conditioner supplying pump 21 via the conditioner agent supply way B2, in order to be provided to the hot water supply way A via the check valve 23. The conditioner agent is mixed with the hot water of the hot water supply way A, thereby preparing mixed water with conditioner agent. The mixed water with conditioner agent is spouted from the nozzle heads N1 to N6, to perform hair washing with conditioner agent with hot water spouted from the shower heads S1 to S11.

Next, a second rinsing process is followed. When the electromagnetic valve 10*k* is closed, in order to stop the spout of the mixed water with conditioner agent from the nozzle heads N1 to N6, thereby allowing hair washing to be performed utilizing the hot water spouted from the shower heads S1 to S11. All processes for hair washing are completed.

However, when hair washing is performed using the prior art hair washer, the neck receiving part arranged at an entering edge part of the cistern becomes cool especially when hair washing is performed in the early morning or winter season. Thus, a person under hair washing feels cool at his nape and this gives rise to feelings of displeasure.

SUMMARY OF THE INVENTION

The present invention is made to solve the above-mentioned problems, and it is an object of the present invention to provide a hair washer which can keep the nape of a person under hair washing warm. According to a first aspect of the present invention, a hair washer which has a hot water storing tank for storing hot water, a cistern. According to a first aspect of the present invention, a hair washer which has a hot water storing tank for storing hot water, a cistern to which a person under hair washing enables to insert, and a neck receiving member provided with a neck receiving part for supporting a nape part of a person under hair washing, wherein a neck receiving part warming conduit for running hot water from the hot water storing tank arranged to touch the neck receiving member is provided. Therefore, when performing hair washing, it is possible to keep the nape part of the person under hair washing warm utilizing the hot water running through in the neck receiving part warming conduit via the neck receiving member.

According to a second aspect of the present invention, a hair washer which has a hot water storing tank for storing hot water, a cistern to which a person under hair washing enables to insert, and a neck receiving member provided with a neck receiving part for supporting a nape part of a person under hair washing, wherein the neck receiving member is made of a hollow member, and comprising; a hot water supply way of the neck receiving part for supplying hot water from the hot water storing tank to the neck receiving member, and a hot water drain way of the neck receiving part for draining hot water in the neck receiving member. Therefore, when performing hair washing, it is possible to run the hot water from the hot water storing tank through in the neck receiving member, thereby keeping the nape part of the person under hair washing warm by the neck receiving member.

According to a third aspect of the present invention, a hair washer as defined in claim 2, wherein the neck receiving member is made of a hollow elastic member having resiliency, and comprising; an electromagnetic valve, which is provided in midway of the hot water supply way of the neck receiving part for performing a supply and a stop of a supply of hot water to an inside of the neck receiving member by opening/closing operations of the electromagnetic valve, an electromagnetic valve, which is provided in midway of the hot water drain way of the neck receiving part for performing a start and a stop of a drain of the hot water in the neck receiving member by opening/closing operations of the electromagnetic valve, a hydraulic pressure sensor for measuring a hydraulic pressure of the neck receiving member, and an electromagnetic control part for controlling opening/closing operations of the electromagnetic valves of the hot water supply way of the neck receiving part and the hot water drain way of the neck receiving part to set a hydraulic pressure of the neck receiving member at a predetermined pressure based on the hydraulic pressure of the neck receiving member measured by the hydraulic pressure sensor. Therefore, when performing hair washing, it is possible to run hot water from the hot water storing tank through the neck receiving member. The opening/closing operations of the electromagnetic valves of the hot water supply way of the neck receiving part and the hot water drain way of the neck receiving part are controlled by the electromagnetic valve control part, to control the supply to the hollow part of the neck receiving member and the drain of the hot water from the hollow part of the neck receiving member, thereby setting a hydraulic pressure of the neck receiving member to a predetermined pressure. Therefore, it is possible to keep the nape of the person under hair washing warm, as well as support same resiliently with a suitable cushion formed by the neck receiving member.

DETAILED DESCRIPTION OF THE PREFERRED EMBODIMENTS

Embodiment 1

Figure 1:
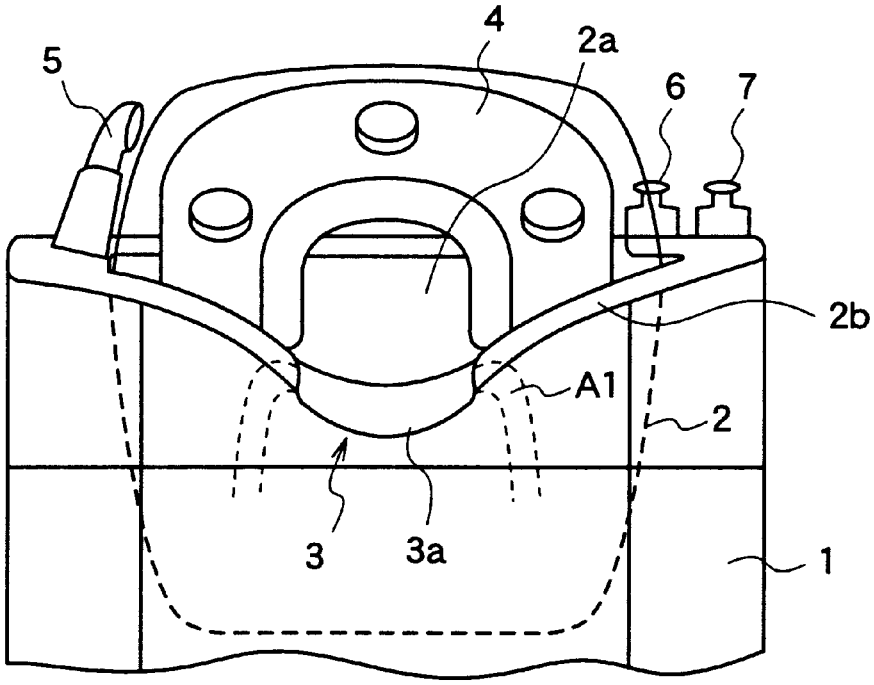
FIG. 1 is an elevation schematically illustrating a structure of a hair washer according to a first embodiment of the present invention.
Figure 2:
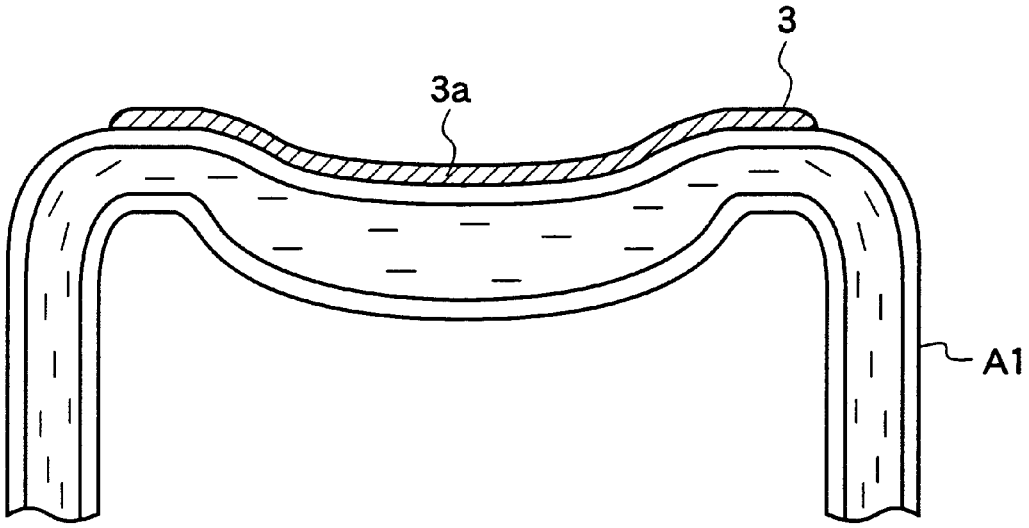
FIG. 2 is a longitudinal cross sectional view illustrating a structure of a neck receiving part at an entering edge part of a cistern of a hair washer according to the first embodiment.
Figure 3:
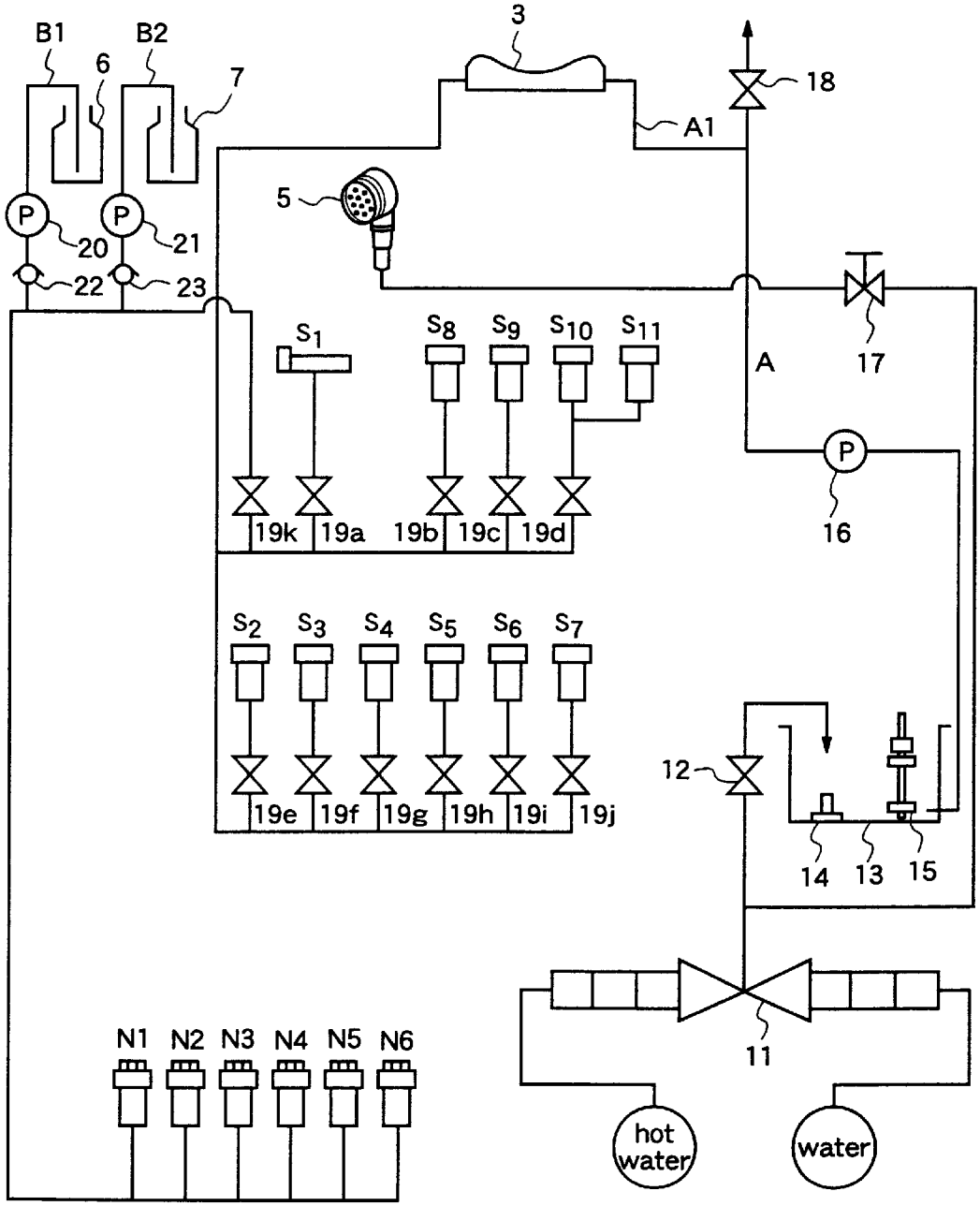
FIG. 3 is a diagram illustrating a structure of pipe arrangement in a cabinet of a hair washer according to the first embodiment.
Figure 6:
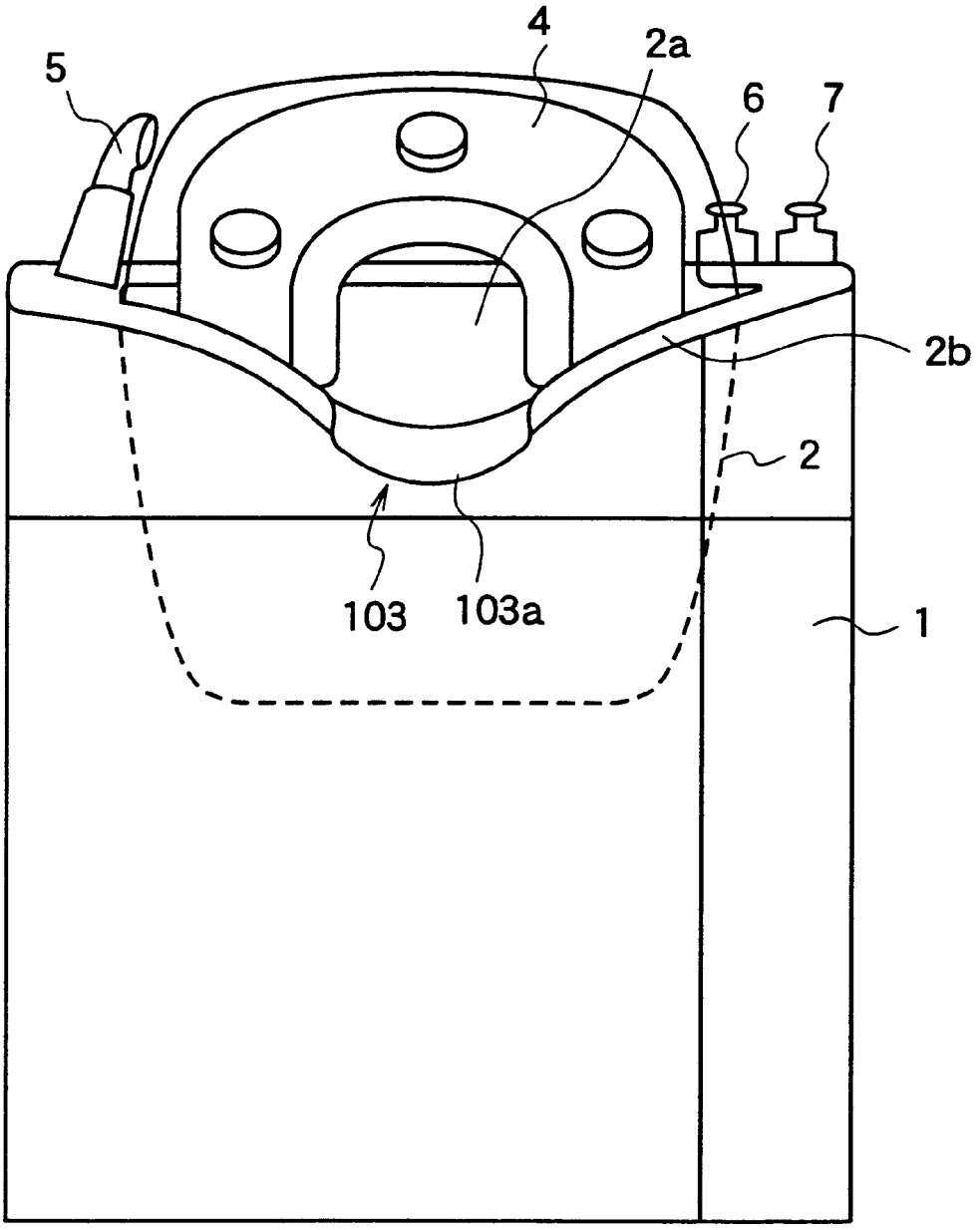
Fig.6 Prior Art
FIG. 6 is an elevation schematically illustrating a structure of a prior art hair washer.
Figure 7:
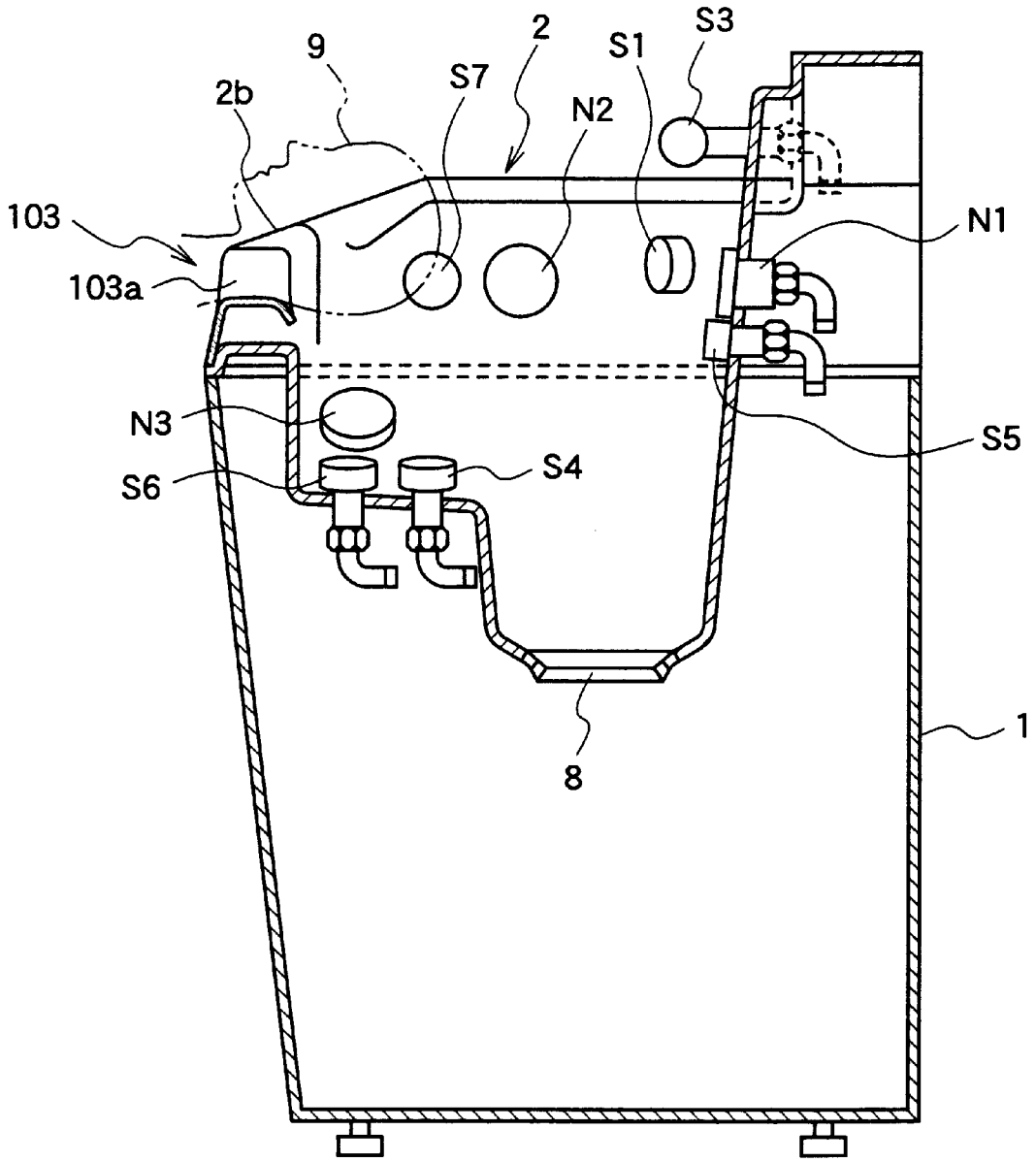
Fig.7 Prior Art
FIG. 7 is a longitudinal cross sectional view schematically illustrating a structure of a prior art hair washer.
Figure 8:
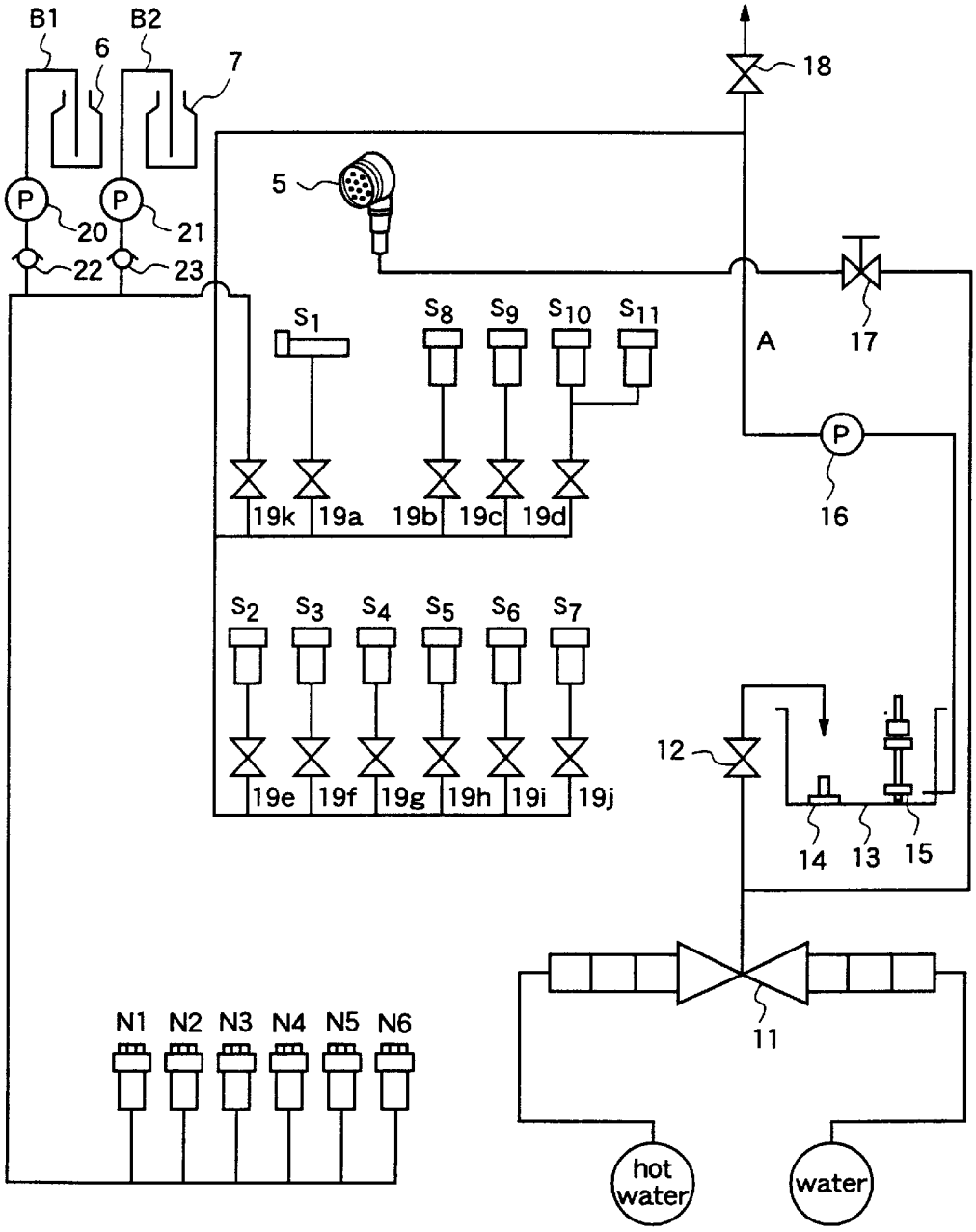
Fig.8 Prior Art
FIG. 8 is a diagram illustrating a structure of pipe arrangement in a cabinet of a hair washer of a prior art hair washer.

FIG. 1 is an elevation schematically illustrating a structure of a hair washer according to a first embodiment of the present invention. FIG. 2 is a longitudinal cross sectional view illustrating a structure of a neck receiving part at an entering edge part of a cistern of a hair washer according to the first embodiment. FIG. 3 is a diagram illustrating the structure of the pipe arrangement in a cabinet of a hair washer according to the first embodiment. In the figures, the same reference numerals and characters as those in FIGS. 6 to 8 designate the same or corresponding parts. In addition, character A1 designates a neck receiving part warming conduit arranged midway of the hot water supply way A. The neck receiving part warming conduit A1 is arranged to touch the under surface of a neck receiving member 3 arranged at an entering edge part of the cistern 2. Here, the neck receiving member 3 is made of an elastic material having resiliency, such as rubber.

Hereinafter, the operation will be explained of the hair washer of the first embodiment with reference to FIGS. 1 to 3.

First, when a hair washer started, hot water and water are supplied to the mixing tank 11 from an external water supply and an external hot water supply, via the curb stop, the strainer, and the check valve. The hot water and the water are is mixed by the mixing tank 11 to prepare hot water having a temperature suitable for hair washing, which is provided to the hot water storing tank 13 via the motor valve 12.

At the time when predetermined amounts of hot water are stored in the hot water storing tank 13, stand-by mode follows.

During the mode, after the person under hair washing 9 inserts his head into the opening 2*a* of the cistern 2 while lying on his back, and puts his head on the neck receiving part 3*a*, the face cover 4 is closed.

Next, in the same manner as hair washing processes performed by the prior art hair washer, hot water stored in the storing tank 13 is pumped out by the hot water supplying pump 16, in order to be provided to the hot water supply way A. The hot water runs through the neck receiving part warming conduit A1 arranged to touch the under surface of the neck receiving member 3, on its way to be provided to the shower heads S1 to S11 and the nozzle heads N1 to N6 via the hot water supplying electromagnetic valves 19*a* to 19*k* so that hot water is spouted from the shower heads S1 to S 11 and mixed water with shampoo agent or mixed water with conditioner agent is spouted from the nozzle heads N1 to N6. Therefore, it is possible to perform an initial draining, a preliminary washing, a washing with shampoo agent, a first rinsing, a washing with conditioner agent, and a second rinsing.

In the above-described washing processes, the nape of the person under hair washing 9 can be kept warm utilizing the hot water running through in the neck receiving part warming conduit A1 via the neck receiving member 3.

As described above, according to the hair washer of the first embodiment, the neck receiving part warming conduit A1 is provided midway of the hot water supply way A for supplying hot water stored in the hot water storing tank 13 to the shower heads S1 to; and S1l and the nozzle heads N1 to N6, and is located so that it touches the under surface of the neck receiving part 3 the neck receiving member is made of an elastic material having resiliency, such as rubber or the like, thereby enabling the hot water to run through the neck receiving part warming conduit A1 touching the under surface of the neck receiving member 3. Thus, it is possible to keep the nape of the person under hair washing 9 warm utilizing hot water running through in the neck receiving part warming conduit A1.

Embodiment 2.

Figure 4:
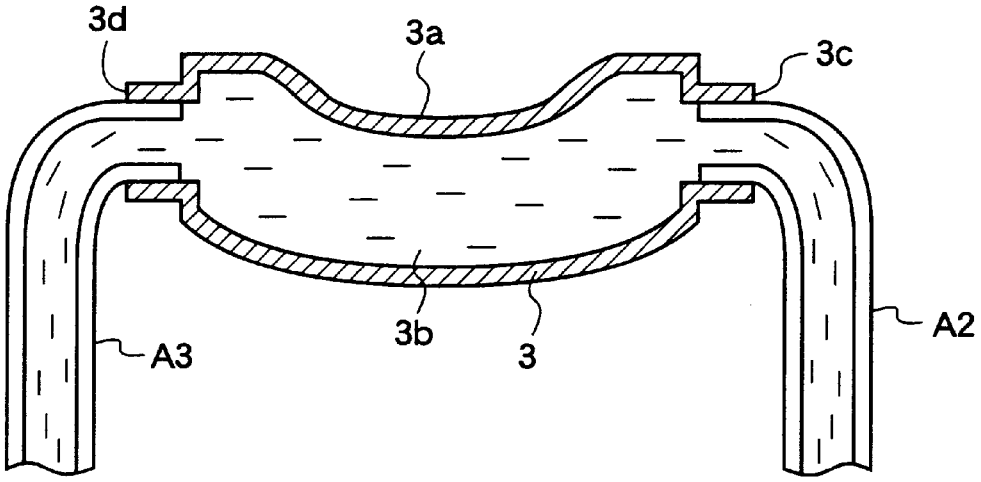
FIG. 4 is a longitudinal cross sectional view illustrating a structure of a neck receiving part at an entering edge part of the cistern of a hair washer to a second embodiment.
Figure 5:
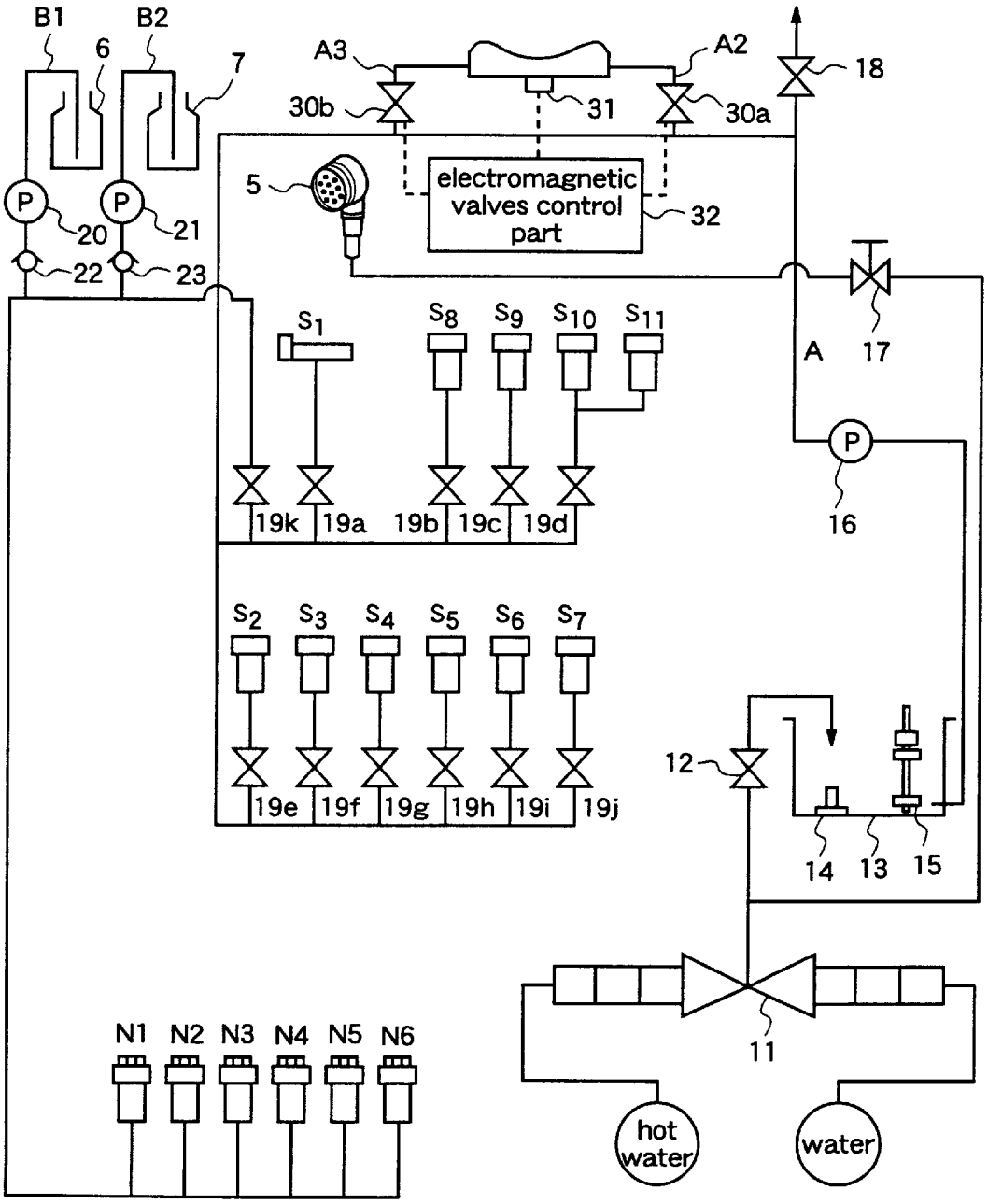
FIG. 5 is a diagram illustrating a structure of pipe arrangement in a cabinet of a hair washer according to the second embodiment.

FIG. 4 is the longitudinal cross sectional view illustrating a structure of the pipe arrangement of the neck receiving part at an entering edge part of the cistern of the hair washer according to a second embodiment. FIG. 5 is a diagram illustrating the structure of the pipe arrangement in a cabinet of a hair washer according to the second embodiment. In the figures, the same reference numerals and characters as those in FIGS. 1 to 3 designate the same or corresponding parts.

As discussed, the neck receiving member 3 is made of an elastic material having resiliency, such as rubber or the like, it has a hollow part 3*b*, and both ends of which comprise a hot water inlet port 3*c* and a hot water outlet port 3*d*. The hot water inlet port 3*c* and the hot water outlet port 3*d* of the neck receiving member 3 are respectively connected to a hot water supply way A2 of the neck receiving part and a hot water drain way A3 of the neck receiving part, which are branched from the hot water supply pipe A. The hot water supply way A2 of the neck receiving part and the hot water drain way A3 of the neck receiving part, respectively, have electromagnetic valves 30*a* and 30*b* midway thereof. The electromagnetic valve 30*a* supplies hot water to the hollow part 3*b* of the neck receiving member 3 by opening/closing operations. The electromagnetic valve 30B drains hot water form the hollow part 3*b* of the neck receiving member 3 by opening/closing operations. Reference numeral 31 designates a hydraulic pressure sensor for measuring hydraulic pressure of the hollow part 3*b* of the neck receiving member 3. Numeral 32 designates electromagnetic valves control part for controlling opening/closing operations of the electromagnetic valves 30*a* and 30*b*.

Hereinafter, the operation will be explained of the hair washer according to the second embodiment with reference to FIGS. 4 and 5.

First, when the hair washer is started, hot water and water are supplied to the mixing tank 11 from an external water supply and an external hot water supply, via the curb stop, the strainer, and the check valve. The hot water and the water is mixed by the mixing tank 11 to prepare water having a temperature suitable for hair washing, which is provided to the hot water storing tank 13 via the motor valve 12.

At the time when predetermined amounts of hot water are stored in the hot water storing tank 13, stand-by mode follows. During the mode, after the person under hair washing inserts his head into the opening 2*a* of the cistern 2 while lying on his back, and puts his head on the neck receiving part 3*a*, the face cover 4 is closed.

Next, in the same manner as hair washing processes preformed by using the prior art hair washer, hot water stored in the storing tank 13 is pumped out by the hot water supplying pump 16, in order to be provided to the shower heads S1 to S11 and the nozzle heads N1 to N6 for hot water through the hot water supply way A via the hot water supplying electromagnetic valves 19*a* to 19*k*, the hot water is spouted from the shower heads S1 to S11, and mixed water with shampoo agent or mixed water with conditioner agent spouted from the nozzle heads N1 to N6. Therefore, it is possible to perform an initial draining, a preliminary washing, washing with shampoo agent, a first rinsing, washing with conditioner agent, and a second rinsing.

In the above-described hair washing processes, the electromagnetic valve 30*a* of the hot water supply way A2 of the neck receiving part and the electromagnetic valve 30*b* of the hot water drain way A3 of the neck receiving part are open by the electromagnetic control part 32, thereby splitting hot water running through in the hot water supply way A into the hot water supply way A2 of the neck receiving part, to be lead to the hollow part 3*b* of the neck receiving member 3 via the electromagnetic valve 30*a*. Further, the hot water of the hollow part 3*b* of the neck receiving member 3 is led to the hot water supply way A via the hot water drain way A3 of the neck receiving part. Therefore, it is possible to run the hot water from the storing tank 13 through the hollow part 3*b* of the neck receiving member 3, thereby enabling the nape of the person under hair washing 9, to be best warm utilizing the hot water of the hollow part 3*b* of the neck receiving member 3.

When the hot water is running through the hollow part 3*b* of the neck receiving member 3, the electromagnetic valve 30*b* of the hot water drain way A3 of the neck receiving part is closed by the electromagnetic control part 32, thus by stopping the drain of the hot water of the hollow part 3*b* of the neck receiving part 3, and only supplying hot water t o the neck receiving part 3. Thereafter, when the hydraulic pressure sensor 31 detects that the hydraulic pressure of the neck receiving member 3 reaches a predetermined hydraulic pressure, the electromagnetic valve 30*a* of the hot water supply way A2 of the neck receiving part is closed by the electromagnetic control part 32. Therefore, the neck receiving member 3 made of an elastic material having resilience, such as rubber or the like, can be kept at suitable pressure for the nape of the person under hair washing 9.

As described above, the hair washer according to the second embodiment comprises the hot water inlet port 3*c* and the hot water outlet port 3*d* at the hollow neck receiving member 3 made of an elastic material having resiliency, such as rubber or the like, the hot water inlet port 3*c* and the hot water outlet port 3*d* are respectively connected to the hot water supply way A2 of the neck receiving part and the drain port A3 of the neck receiving part which are respectively branched from the hot water supply way A, thereby enabling the hot water thus from the hot water storing tank 13 through the hollow part 3*b* of the neck receiving member 3. In addition, the electromagnetic valve control part 32 controls the opening/closing operations of the electromagnetic valve 30*a* of the hot water supply way A2 of the neck receiving part and the electromagnetic valve 30*b* of the hot water drain way A3 of the neck receiving part, to control a supply of the hot water to the hollow part 3*b* of the neck receiving member 3 and a drain from the hollow part 3*b* of the neck receiving member 3, thereby enabling the setting the hydraulic pressure of the hollow part 3*b* of the neck receiving part 3 to a predetermined pressure. Therefore, it is possible to keep the nape of the person under hair washing 9 warm as well as support same resiliently with a suitable cushion formed by the neck receiving member 3.

What is claimed is:

1. A hair washer comprising:

a hot water storing tank for storing hot water;

a cistern for receiving at least the hair of a person undergoing hair washing, said cistern including shower heads and nozzle heads in an interior thereof;

a neck-receiving member provided on said cistern for supporting the back of the neck of the person undergoing hair washing; and a conduit running below said neck-receiving member and connecting said hot water storing tank to said shower heads and nozzle heads in said cistern;

whereby the hot water passing through said conduit heats said neck-receiving member and thus the back of the neck of the person undergoing hair washing.

2. A hair washer comprising:

a hot water storing tank for storing hot water;

a cistern for receiving at least the hair of a person undergoing hair washing, said cistern including shower heads and nozzle heads in an interior thereof, and a neck-receiving member having opposed ends, said neck receiving member provided on said cistern for supporting the back of the neck of the person undergoing hair washing;

wherein said neck-receiving member is hollow and includes a hot water supply pipe, provided at one end of said neck-receiving member, for supplying hot water from the hot water storing tank to the neck-receiving member and a hot water draining pipe, disposed on an opposite end of said neck receiving member, for draining hot water from the neck-receiving member.

3. The hair washer as defined in claim 2, wherein the neck-receiving member is made of a resilient material, and said hair washer further comprises:

an electromagnetic valve provided in the hot water supply pipe for starting and stopping the supply of hot water to the neck-receiving member;

an electromagnetic valve provided in the hot water draining pipe for starting and stopping the supply of hot water from the neck-receiving member;

a hydraulic pressure sensor for sensing the hydraulic pressure of the neck-receiving member; and electromagnetic control means for controlling the opening and closing operations of the electromagnetic valves of the hot water supply pipe and the hot water draining pipe in order to set the hydraulic pressure of the neck-receiving member at a predetermined level established by the hydraulic pressure sensor.

* * * * *